United States Patent [19]

Hellekant

[11] Patent Number: 4,547,185

[45] Date of Patent: Oct. 15, 1985

[54] BALANCING OF CENTRIFUGE ROTORS

[75] Inventor: Otto E. Hellekant, Rönninge, Sweden

[73] Assignee: Alfa-Laval Separation AB, Tumba, Sweden

[21] Appl. No.: 644,384

[22] Filed: Aug. 27, 1984

[30] Foreign Application Priority Data

Sep. 13, 1983 [SE] Sweden ..... 8304901

[51] Int. Cl.[4] ..... B04B 9/14

[52] U.S. Cl. ..... 494/37; 494/82

[58] Field of Search ..... 494/37, 23, 27, 46, 494/82, 84; 68/23.2; 210/144, 360.1; 74/573 R, 573 F

[56] References Cited

U.S. PATENT DOCUMENTS 2,659,243 11/1953 Darrieus ..... 74/573
3,796,109 3/1974 Lagerwey ..... 494/46
4,412,831 11/1983 Avery ..... 494/46
4,433,592 2/1984 Tatsumi ..... 68/23.2

FOREIGN PATENT DOCUMENTS 719422 12/1954 United Kingdom .

*Primary Examiner*—Robert W. Jenkins
*Attorney, Agent, or Firm*—Cyrus S. Hapgood

[57] ABSTRACT

An arrangement for balancing a centrifuge rotor during operation comprises means (5, 8) forming an annular channel (11) which concentrically surrounds the rotational axis of the rotor and in which there are arranged three separately movable balancing bodies (12). The annular channel (11) is partly defined by a slide (8) movable axially by control means (9, 14–17) to and from contact with the balancing bodies (12) for arresting and releasing them in the channel during the rotor operation.

8 Claims, 2 Drawing Figures

BALANCING OF CENTRIFUGE ROTORS

Figure 1:
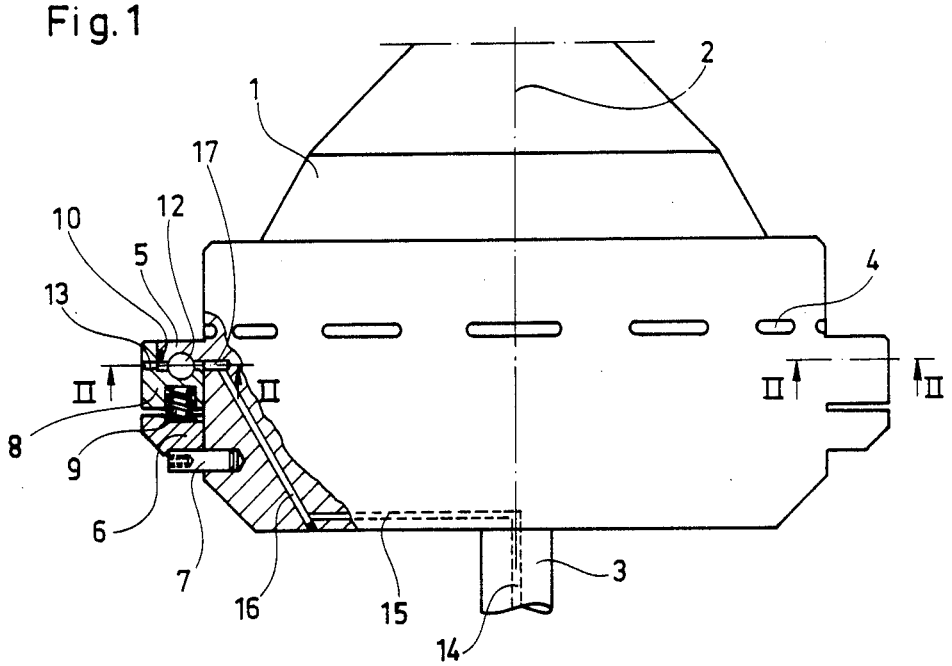

The present invention relates to an arrangement in a centrifugal separator for balancing the centrifuge rotor during operation against the action of undesired centrifugal forces caused by the center of gravity of the rotor being displaced from the rotational axis of the rotor. The invention further relates to a method of balancing a centrifuge rotor by means of such an arrangement.

During the operation of a centrifugal separator, an unbalance of the centrifuge rotor often occurs. This may depend on uneven distribution of sludge separated in the separating chamber. In so-called nozzle separators, where separated sludge is continuously discharged through several nozzles distributed around the periphery of the centrigure rotor, an uneven distribution of sludge in the separating chamber may occur by one or more of the nozzles becoming clogged, occasionally or permanently, or by one or more nozzles becoming more worn than others and letting out more sludge per unit of time. In centrifugal separators with intermittently openable outlets at the rotor periphery, an uneven distribution of sludge arise as a consequence of sludge adhering to the rotor walls in the separating chamber and not being discharged through the outlets in a sludge discharge operation.

There is no arrangement available on the market today by which occasionally arising unbalance of a centrifugal separator can be corrected during operation. Such unbalance—like permanent unbalance—thus has to be accepted in practice as long as it remains within certain limits, which means, however, that the bearings of the centrifuge rotor are subjected to excessive load and wear.

The principal object of the present invention is to provide a simple and easily operable arrangement which can correct a certain unbalance of a centrifuge rotor during operation. This object is achieved by an arrangement comprising means rotatable with the rotor and forming an annular channel concentrically surrounding the rotational axis and containing at least two, preferably three, balancing bodies separately movable within and along the channel, and control means for selectively arresting and releasing the balancing bodies in the channel during operation of the rotor.

A condition precedent for operation of the arrangement according to the invention is that the centrifugal separator be of a kind having a rotor which, during normal operation, rotates at supercritical speed. Then the balancing bodies will take positions in which they neutralize possible unbalance of the rotor (within the limits of the masses of the balancing bodies themselves). Before the rotor has reached supercritical speed, the balancing bodies must be kept arrested in order not to be gathered altogether close to each other within the annular channel and thereby cause unbalance by themselves. Also, when the centrifuge rotor is to be stopped, the balancing bodies must be kept arrested.

In a preferred embodiment of the arrangement according to the invention, one wall of the annular channel is formed by an annular slide movable axially by the control means to and from contact with the balancing bodies to selectively arrest and release them in the channel as the rotor rotates. The control means preferably comprise mechanical springs constantly forcing the slide towards a position in which it arrests the balancing bodies within the channel, and a path for supplying an operating fluid to the channel to move the slide against the action of the mechanical springs, so that the balancing bodies are released in the channel.

An arrangement of this kind guarantees that the balancing bodies can always be arrested during operation of the centrifuge rotor, even if some fault should arise in the supply of operating fluid to the centrifuge rotor. In other words, the centrifuge rotor can always be brought to a standstill, during which the subcritical speed has to be passed, without any risk of unnecessary unbalance coming up.

In the most simple case, pressurized air may be used as the operating fluid for actuating said slide against the action of the mechanical springs. However, it may be advantageous to use instead a liquid, preferably water, since the balancing bodies will then move within a liquid-filled channel. This may cause more stable movements of the balancing bodies. In this case the channel must have a throttled outlet for the liquid in its radially outer wall.

The arrangement according to the invention can be used in different ways. If desired, the balancing bodies may be released as soon as the centrifuge rotor has reached its supercritical speed, and be allowed to freely move within the channel until the rotor is to be stopped. According to a preferred way of using the arrangement, however, the balancing bodies are kept arrested during the main part of the centrifuge rotor operation, the bodies being released only during shorter periods of time to be allowed to take new positions due to unbalance of the rotor coming up during the operation. The latter way of using the arrangement is advantageous, since the consumption of operating fluid thereby can be kept at a minimum.

If the centrifuge rotor is of a kind having means for intermittent discharge of separated sludge during operation, it is believed to be necessary to arrest the balancing bodies before each sludge discharge operation, during which the speed of rotation will be heavily reduced momentarily. Immediately after the speed retardation, the balancing bodies may be released again to compensate as soon as possible for any unbalance arising as a consequence of the sludge discharge operation. The increase of the rotor speed to normal speed after a sludge discharge operation will be relatively slow, and it may be performed with the balancing bodies in released positions.

Figure 2:
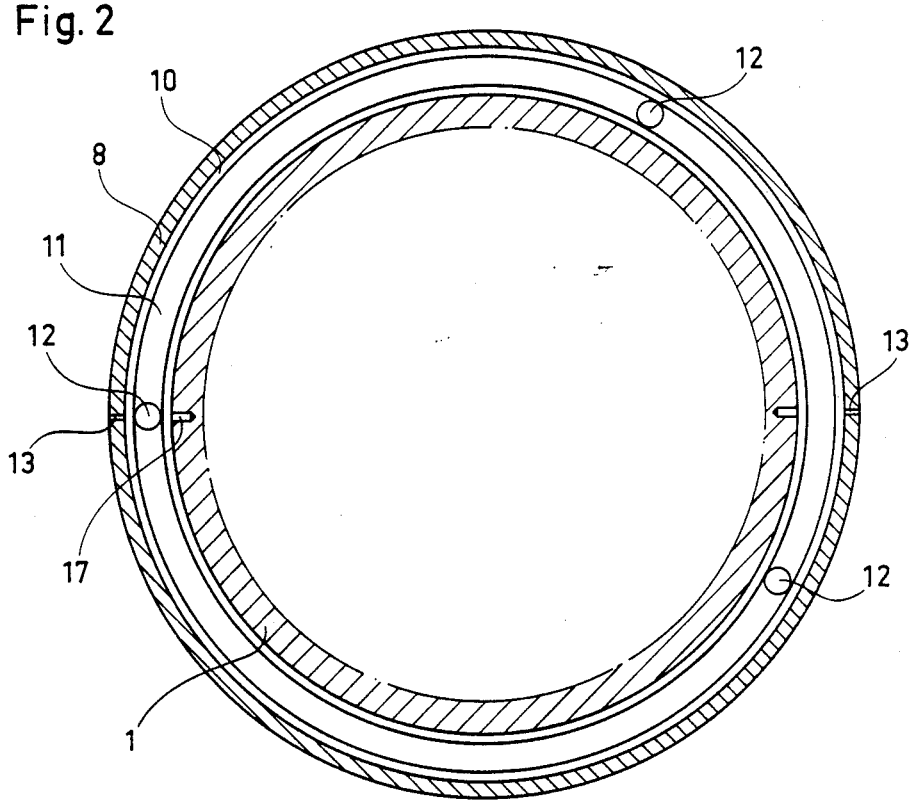

The invention is described in more detail below with reference to the accompanying drawing in which FIG. 1 is an elevational view, partly in section, of a centrifuge rotor provided with an arrangement according to the invention, and FIG. 2 is a sectional view along the line II—II in FIG. 1.

In FIG. 1 a centrifuge rotor 1 is supported and rotatable around a rotational axis 2 by a spindle 3. Around the periphery of the rotor are distributed a number of outlets 4 for sludge which has been separated within the separating chamber of the rotor from a liquid supplied thereto. The rotor shown in the drawing is of a kind having means for intermittent discharge of sludge through the outlets 4 during operation of the rotor.

At its periphery, the rotor supports an upper annular radial flange 5 and a lower annular radial flange 6. The lower flange 6 is removably mounted on the rotor and is supported by a number of pins 7 distributed around the rotor and screwed radially into the wall of the rotor.

Between the flanges 5 and 6 is an annular slide or ring 8 axially movable relative thereto. This ring is kept pressed upwardly towards the flange 5 by a number of coiled springs 9 distributed around the rotor periphery and arranged between the ring 8 and the lower flange 6. Between the upper flange 5 and an upwardly directed portion of the ring 8 is a gasket 10 allowing movement of the ring 8 relative to the flange 5.

The ring 8 and the upper flange 5 constitute means rotatable with the rotor and forming an annular channel 11 extending around the rotor periphery (see FIG. 2) and in which there are placed three balancing bodies in the form of metal balls 12. At some places around the rotor, the channel 11 communicates with the surrounding atmosphere through throttled openings 13 in the radially outer wall of the channel.

The driving spindle 3 of the rotor has a central channel 14 which, through channels 15, 16 and 17 in the rotor body 1, communicates with the annular channel 11. At the lower end of the spindle (not shown) the central channel 14 communicates with means for supply of an operating fluid. This means may be a pressurized air unit but is preferably a pump for supply of liquid, such as water.

If a pressurized air unit is used, the supplied air must have an overpressure which can overcome the pressure of the coiled springs 9. If a liquid pump is used, it is sufficient that it can pump liquid through the spindle 3 and the rotor 1 to the channel 11 where the liquid itself, as a consequence of the centrifugal force, will acquire a pressure overcoming the force from the springs 9.

In operation, while the centrifuge rotor is being rotated but has not yet reached the supercritical speed, the springs ~~9 are~~ forcing the ring 8 upwards, the balls 12 thus being arrested (i.e., squeezed) in the channel 11 between the ring 8 and the upper flange 5. When the rotor has reached the desired rotational speed, water is supplied during a predetermined period of time through the channel 14. Then, after a while, the channels 15–17 and the annular channel 11 are filled with water, and this water will press the ring 8 downwards against the action of the springs 9. The balls 12 now are free to move within the channel 11, and they will automatically take positions in which they cause the rotor's center of gravity to coincide with the rotational axis 2 of the rotor.

The period of time for the supply of water is chosen so that the balls 12 will have time to take their balancing positions in the channel 11. When the water supply has ceased, the water is discharged from the channel 11 and the channels 14–17 through the throttled openings 13 in the outer wall of the channel 11, the springs 9 being again able to force the ring 8 upwards to arrest the balls 12.

Renewed balancing of the rotor may be performed in the above-described manner at desired time intervals during the rotor's operation.

The location of channel 11 and the balancing bodies 12 along the rotational axis 2 is preferably chosen so that they will be situated in the plane of the expected unbalance of the centrifuge rotor. Within the scope of the invention, it should be evident that more than one annular channel with balancing bodies may be arranged along the rotational axis, if needed.

As will be understood from the foregoing, the springs 9 and the path 14–17 for supplying operating fluid to channel 11 constitute control means for selectively arresting and releasing the balls 12 by moving slide 8 to and from contact with the balls.

I claim:

1. A centrifugal separator comprising a rotor operable by rotation about an axis to effect separation of a mixture within the rotor, the rotor having an annular channel concentrically surrounding said axis, at least two balancing bodies separately movable in said channel, said bodies being freely movable along the channel to different locations for balancing the rotor against the action of undesired centrifugal forces caused by the center of gravity of the rotor being displaced from said axis, arresting means rotatable with the rotor and movable axially thereof between a first position in which said bodies are freely movable along the channel and a second position in which said bodies are held against movement along the channel, and control means operable at will during rotation of the rotor at a constant speed to move the arresting means back and forth between said two positions.

2. The separator of claim 1, in which said arresting means include a member partly defining said annular channel.

3. The separator of claim 2, in which said member is an annular slide.

4. The separator of any of claims 1, 2 and 3, in which said control means include mechanical springs urging said arresting means toward said second position, and a path in the rotor for supplying operating fluid to the channel to move said arresting means against the action of said springs to said first position.

5. The separator of claim 4, in which said channel has at least one throttled outlet for operating fluid in the radially outer wall of the channel.

6. The separator of claim 1, in which there are three of said balancing bodies.

7. In the operation of a centrifugal separator having a rotor mounted for rotation about an axis, the rotor being subject to unbalance during operation and having an annular channel concentrically surrounding said axis, said channel containing at least two balancing bodies separately movable within and along said channel, the method which comprises maintaining said bodies arrested in said channel during the main part of the rotor operation, and releasing said bodies only during short periods of time to allow them to take new positions in the channel depending upon the unbalance of the rotor arising during operation.

8. The method of claim 7, which comprises also discharging separated sludge intermittently from the rotor, thereby temporarily reducing its rotational speed from a normal operating speed, said bodies being released while the rotor accelerates from its reduced speed to said normal speed.

* * * * *